US007172044B2

(12) United States Patent
Bouvet

(10) Patent No.: US 7,172,044 B2
(45) Date of Patent: Feb. 6, 2007

(54) SELF-PROPELLED WHEEL BOARD

(76) Inventor: Alain Bouvet, 21 rue Fabrot, Aix en Provence (FR) F-13100

( * ) Notice: Subject to any disclaimer, the term of this patent is extended or adjusted under 35 U.S.C. 154(b) by 18 days.

(21) Appl. No.: 10/529,875

(22) PCT Filed: Sep. 30, 2003

(86) PCT No.: PCT/FR03/02861

§ 371 (c)(1),
(2), (4) Date: Apr. 1, 2005

(87) PCT Pub. No.: WO2004/030774

PCT Pub. Date: Apr. 15, 2004

(65) Prior Publication Data

US 2006/0012141 A1 Jan. 19, 2006

(30) Foreign Application Priority Data

Oct. 1, 2002 (FR) ..... 02 12142

(51) Int. Cl.
*A63C 5/08* (2006.01)

(52) U.S. Cl. ..... 180/181; 180/180; 180/15; 180/74; 280/11.11; 280/87.04

(58) Field of Classification Search ..... 180/15, 180/74, 180, 181; 280/11.11, 87.04
See application file for complete search history.

(56) References Cited

U.S. PATENT DOCUMENTS 4,073,356 A * 2/1978 Schlicht ..... 180/181
5,839,737 A * 11/1998 Kruczek ..... 280/11.115
6,848,527 B2 * 2/2005 Nelson ..... 180/181

FOREIGN PATENT DOCUMENTS

DE 3427834 A 2/1986
WO WO 02/26334 A1 4/2002

* cited by examiner

*Primary Examiner*—J. Allen Shriver
*Assistant Examiner*—Cynthia F. Collado
(74) *Attorney, Agent, or Firm*—Browdy and Neimark, PLLC

(57) ABSTRACT

A wheel board comprising a wheel (2) with a diameter of 0.2 to 0.6 m mounted on a free wheel (21), mounted on an axle (3) situated on a vertically pivoting arm (4) arranged on the board (1), and mounted freewheeling and driven by a driving drum (17) around which is wound a band (11) that is fixed to said driving drum (17) by a first end and that is connected to the board by its second end, said driving drum (17) being equipped with a return device (19) so that, when the board (1) is not loaded, the central wheel (2) is in a lower position relative to said board (1) and said band (11) is wound around the drum (17) driving the wheel.

11 Claims, 3 Drawing Sheets

SELF-PROPELLED WHEEL BOARD

This invention relates to a wheel board fitted with a means of propulsion that can be used in particular for leisure activities.

Sports that involve gliding or sliding are currently experiencing significant expansion. On the ground, on the sea or on snow, new disciplines are continually appearing, supported by a veritable popular craze. These different sports produce unique sensations of speed and height, curves, the wind in your face, freedom, or, in a word, gliding.

However the media on which certain sports can be practiced, such as surfing, limit their development. It would therefore be desirable to have access to a device reproducing the sensations of the surf on the ground and capable of moving over flat ground at a sufficient speed to reproduce the gliding sensation of the surf.

Skateboards are already known, but from time to time, one of the user's feet must leave the surface of the board in order to add speed.

However, after much research, the applicant has developed a novel type of wheel board, the principle of which is to transform the energy provided to the board when the user jumps in order to allow the rapid forward movement of the system, avoiding having to push on the ground with the foot.

The object of this application is therefore a wheel board comprising a wheel, preferably central, with a diameter ranging from 0.2 to 0.6 m mounted on a free wheel, said central wheel being mounted on an axle situated on a vertically pivoting arm (hereafter the first arm) arranged on the board, said central wheel being mounted freewheeling and being driven by a drum around which is wound a band that is fixed to said drum by a first end and that is connected to the board by its second end, said drum being equipped with a return device so that, when the board is not loaded, the central wheel is in a lower position relative to said board and said band is wound around the drum of the wheel. A wheel board according to the invention optionally also comprises castors.

The pivot pin of the arm is preferably arranged at a first end of the pivoting arm, and the wheel shaft towards the other end.

In preferable conditions of embodiment of the invention, the band is connected to the board not directly but by means of a second vertically pivoting arm arranged on the board. Such a device allows for an increase in the traction length of the band for the same vertical travel of the board.

A further object of this application is therefore a wheel board as above also comprising a second vertically pivoting arm arranged on the board, said band being connected to the board by means of said second pivoting arm. The second end of the band can be fixed to said second pivoting arm, or not, for example in order to increase the length of the band as will be seen below. In this latter case, a pulley for example is provided at the second end of the second pivoting arm in order to constitute a countergear of the band, in particular in order to fix it directly to the board and thus considerably increase the length of the band and therefore the potential speed.

In other preferred conditions of embodiment of the invention, the first arm is equipped with an additional return device so that, when the board is not loaded, the return device of the drum is assisted in returning the central wheel to the lower position relative to said board and facilitates the winding of said band around the drum of the wheel.

In one variant of the invention, said second arm is also equipped with a return device so that, when the board is not loaded, the central wheel is returned to the lower position relative to said board and said band winds itself more easily around the drum of the wheel.

In another variant of the invention, the return device is arranged only on said second arm.

In yet an other variant of the invention, the return device is a mechanism for winding the band such was a spiral spring.

In yet other preferred conditions of embodiment of the invention, the first arm is connected to the second arm by a bracket such as a link preferably arranged between the second end of the first pivoting arm and approximately the middle of the second pivoting arm.

In yet other preferred conditions of embodiment of the invention, the wheel board also comprises at the front and rear swivelling castors like a conventional skateboard. The wheel board thus comprises axles that can change direction as a result of the lateral inclination of the board. Recourse can also be had to wheels such as those used on supermarket trolleys. They also react by turning when there is a change in the inclination of the board. However, unlike the wheels mounted on conventional skateboards, they are independent.

Provision can be made for a central driving wheel and two supports, at the front and rear. Provision can be made for trucks or similar, a centred castor or a mixture of the two.

Provision can be made for the wheel not to be in the centre of the board, but at one end. The user then does not have his feet on each side of the wheel, but on the same side.

Provision can also be made for two driving wheels instead of only one.

In yet other preferred conditions of embodiment of the invention, the band is wound around a drum fixed to the wheel. The drum replaces the conventional cassette of bicycles with one or more gears and is equipped with a return device. The return device advantageously comprises a spiral spring (of the type used in watch-making), with appropriate power.

The band can be for example a chain, a cable and preferably a belt.

In yet other preferred conditions of embodiment of the invention, the width of the above wheel board, is advantageously between 0.20 m and 0.37 m, preferably between 0.22 m and 0.35 m, and most particularly between 0.25 m and 0.32 m.

A non-slip coating is advantageously provided on its upper surface.

Provision can advantageously be made for a braking system, to allow the user to avoid an obstacle or simply to stop. It can in particular act on the wheel, on the castors, or rub on the ground.

The height clearance of the wheel board of the invention is advantageously set between 0.10 m and 0.32 m, preferably between 0.13 m and 0.28 m, in particular between 0.15 m and 0.25 m, and most particularly between 0.17 m and 0.23 m.

The diameter of the wheel is advantageously between 0.25 m and 0.45 m, preferably between 0.28 m and 0.40 m, in particular between 0.30 m and 0.40 m, and most particularly between 0.32 m and 0.37 m.

In yet other preferred conditions of embodiment of the invention, one or more of the parts that can be duplicated are duplicated, on either side of the wheel, for the sake of both balance and of strength and efficiency. Thus the above wheel board advantageously comprises two free wheels, two first arms, two second arms, two links, two bands etc. However, the arms in the same pair are then preferably mounted on a single shaft and are contiguous, so as to be interdependent; there is also only one axle of the wheel.

In yet other preferred conditions of embodiment of the invention, the above wheel board advantageously comprises an energy storage system. Thus the user can pump for a few moments, then let themselves roll. To this end a spring may be used for example that stores the energy provided by the user, such as a spiral spring of the type used in watchmaking, in order to deliver it more slowly.

In yet other preferred conditions of embodiment of the invention, the above wheel board advantageously comprises preferably arc-shaped foot-straps open on the wheel side to allow for the rapid release of the foot. However the foot remains firmly locked by spreading the legs.

The wheel board according to the invention can be used as follows:

When starting, a small run-up is taken as for a conventional skateboard and the feet are slipped into the foot-straps; at this point the wheel is in the upper position relative to the board and the band is unwound. The user jumps upwards and the discharge of the weight causes the wheel to move to the lower position and the band to wind around its winding drum.

When the body comes back down, the pressure on the board causes the first pivoting arm to pivot upwards, which also drives the second pivoting arm upwards, which thus pulls on the band and drives the wheel in rotation. The successive thrusts provided by the user suffice to propel the board according to the invention. The user transforms his vertical thrusting movement into horizontal motion of the board.

The principle of use, in the case of a system with 2 swinging arms and a link is as follows. When the user jumps on the board, the wheel and the first arm rise. The link pulls the second arm upwards. At its end is fixed the band, the unwinding of which drives the wheel in rotation. A vertical travel of the board of 0.08 m moves the board forward for example by 0.9 m to 1 m.

Since the wheel must continue to turn when the belt winds up, a free wheel is provided. And since the band must wind up when the arms descend, for example a return spring of the drum on which the band is wound ensures the return of the latter.

In other preferred conditions of embodiment of the invention, the free wheel is a composite free wheel. It preferably comprises two additional roller cages.

The wheel boards that are the object of this invention possess very beneficial qualities.

In particular they allow for movement over flat ground at a sufficient speed to reproduce the gliding sensation of the surf. They also allow for bends to be taken, are stable, easily transportable, allow for jumping for the version with foot-straps, and are easy to produce and repair.

They are relatively easy to master. Tens of minutes are enough to become familiar with their use, even for those who do not practice board sports.

They justify the use of the wheel boards described above, as a means of movement over the ground, in particular for ground surfing.

The invention will be better understood by referring to the appended drawings, in which FIG. 1 shows a side view of a board according to the invention in which the wheel is in the lower position relative to the board.

Figure 1:
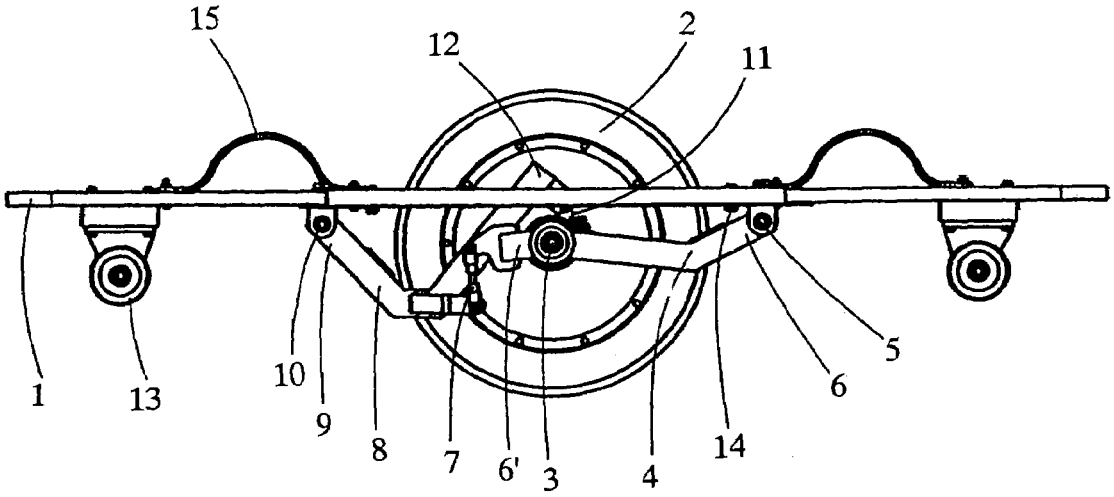

In FIG. 1, a board 1 comprising a wheel 2 mounted on two free wheels can be seen. The wheel 2, 40 mm in width and 350 mm in diameter, is mounted on an axle 3 situated on a first arm 4. This first arm 4 can pivot vertically around a shaft 5 provided at a first end 6 of said first pivoting arm 4 fixed to the board 1. The shaft 5 is arranged in a bearing equipped with self-lubricating bushings.

At its second end 6', a link 7 is arranged connected to the middle of a second pivoting arm 8 in the shape of an L. The first end 9 of said second pivoting arm, situated on the small branch of the L, is hinged pivotably around a shaft 10 fixed to the board 1. The shaft 10 is also arranged in a bearing equipped with self-lubricating bushings.

A band 11, here a polyurethane belt reinforced with steel cables, is fixed towards the second end 12 of said second pivoting arm 8.

This board is equipped at the front and rear with articulated tandem wheels 13 of the skateboard type called trucks.

Rubber stops 14 are provided under the board 1 in order to prevent the pivoting arms 4, 8 from hitting the board violently.

Closed arc-shaped foot-straps 15 can also be seen. They can be provided rigid and open on the inner side (the wheel side) in order to allow for the rapid release of the foot.

Figure 2:
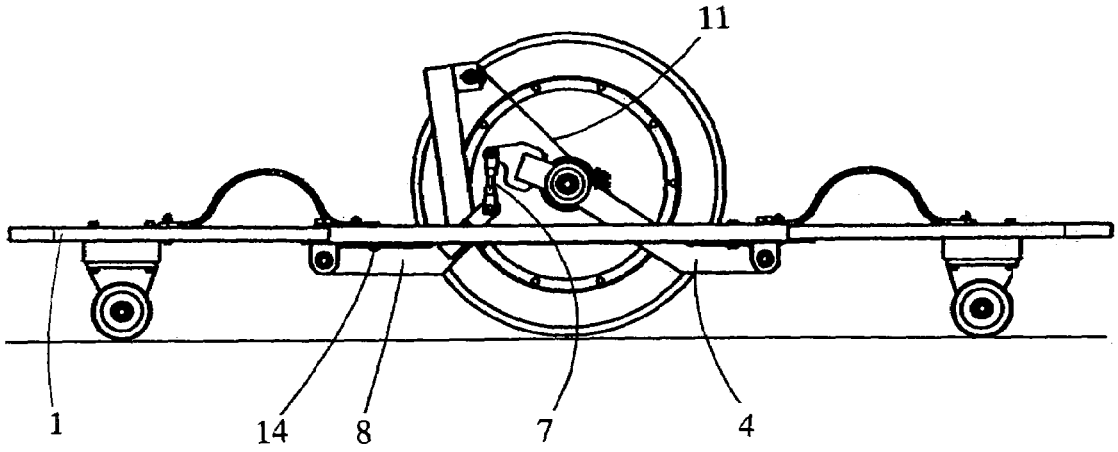
FIG. 2 shows a side view of a board according to the invention in which the wheel is in the upper position relative to the board.

As can be seen in FIG. 2, which shows the same components as in FIG. 1, pressure on the board 1 has lowered it into contact with the ground, and the pivoting upwards of the first pivoting arm 4 has caused the raising of the second pivoting arm 8 by means of the link 7. The traction on the band 11 has caused the rotation of the wheel and consequently the propulsion of the board.

Given the shapes chosen for the first and the second pivoting arms, when the wheel 2 is in the upper position relative to the board 1, the lower branches of the pivoting arms 4, 8 are approximately parallel to the ground, which allows for optimization of the ground clearance of the wheel board according to the invention. In such a configuration, the rubber stops 14 are justified.

An undeniable advantage of this solution is the disappearance of all mechanisms below the board. The movement of the arms allows for the whole system to be retracted by raising it above the board. Thus, the risk of catching and damaging the mechanism is very small. Obstacles may even be ridden over because the system automatically retracts in the event of an impact.

It can also be seen that the belt 10 has been pulled, which has caused the rotation of the drum around which it was wound in FIG. 1 and the driving in rotation of the wheel.

Figure 3:
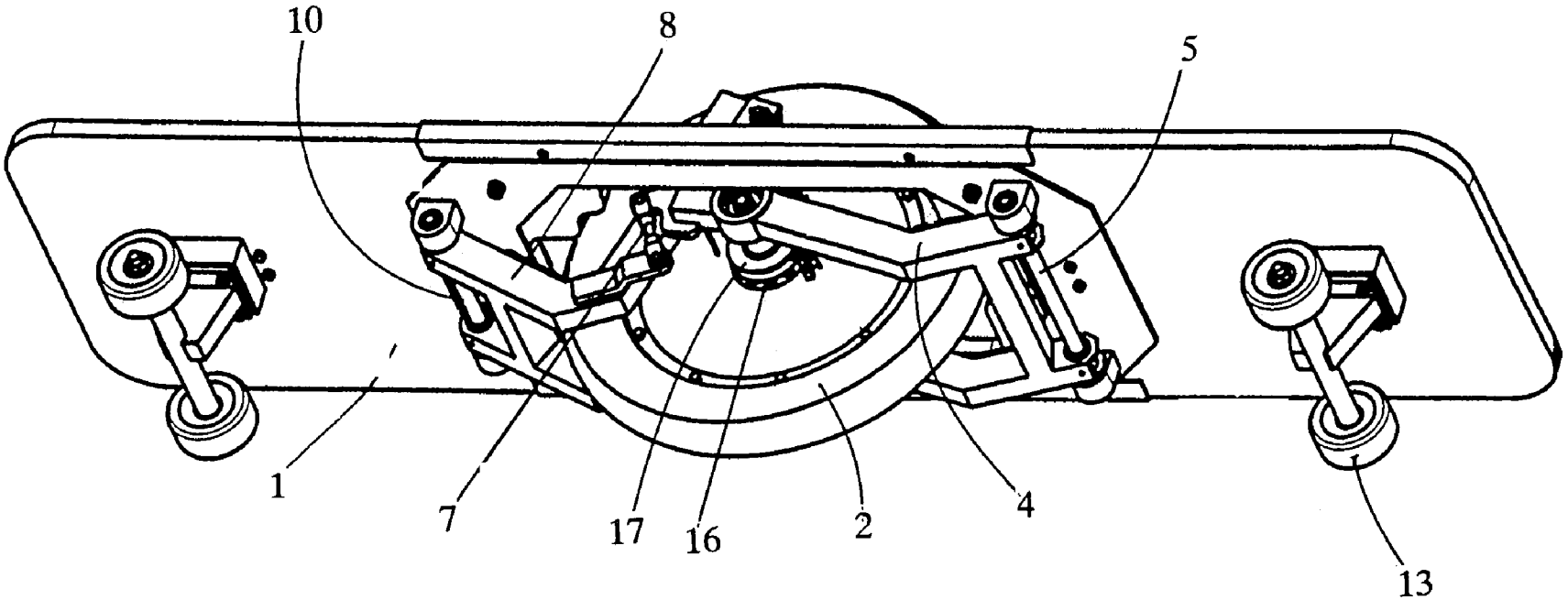
FIG. 3 shows a perspective bottom view of a board according to the invention.

In FIG. 3, the assembly of the first pivoting arm 4 and of the second pivoting arm 8 can be seen more clearly. These arms are mounted on pins 5, 10, themselves arranged in bearings equipped with self-lubricating bushings.

On one side of the wheel 2, firstly, a drum 16 on which a spiral spring is mounted, and, secondly, a drum 17 on which a band (not shown) is arranged, can also be seen.

Figure 4:
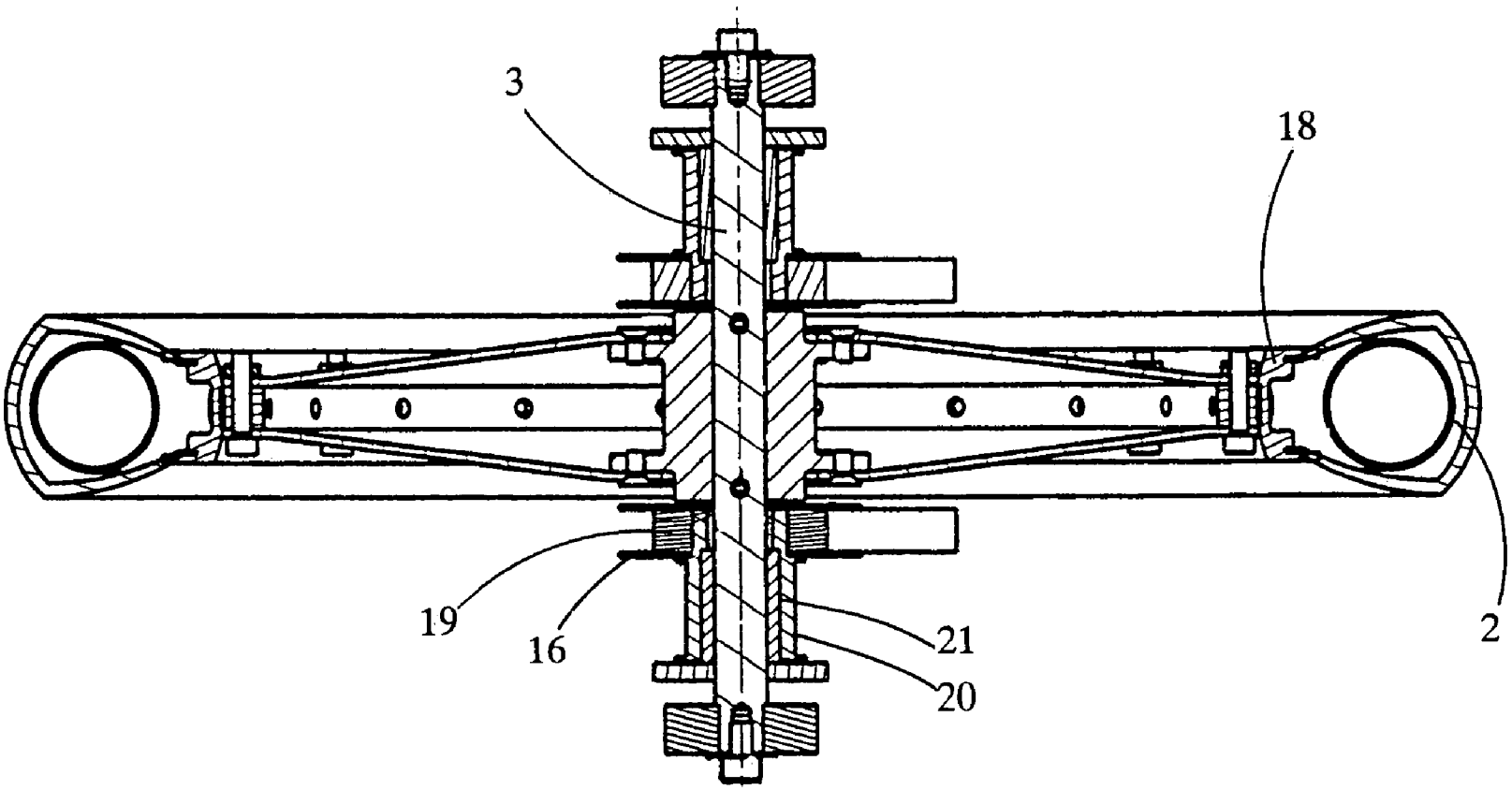
FIG. 4 shows a diametric sectional view of the wheel arranged on its shaft.

Such drums can be found in a symmetrical manner on the other side of the wheel as can be seen more clearly in FIG. 4.

In FIG. 4, the wheel 2 can be seen mounted on its wheel rim 18 in rotation around the wheel axle 3.

A first spiral spring 19 is arranged on one side of the wheel in its drum 16. This drum drives the driving drum 17, 20 around which a band 11 (not shown) winds. These two drums are mounted on a composite free wheel 21 that allows for the driving of the wheel during traction on the band 11 and leaves the wheel free to turn in particular during the unwinding of said band 11 under the action of the spiral spring 19.

The invention claimed is:

1. A wheel board comprising a central wheel (2) with a diameter ranging from 0.2 to 0.6 m mounted on a free wheel (21), said central wheel (2) being mounted on an axle (3) situated on a vertically pivoting first arm (4) (hereafter the first arm) arranged on the board (1), said central wheel (2) being mounted freewheeling and being driven by a driving drum (17) around which is wound a band (11) that is fixed to said driving drum (17) by a first end and that is connected to the board by its second end, said driving drum (17) being equipped with a return device (19) so that, when the board (1) is not loaded, the central wheel (2) is in a lower position relative to said board (1) and said band (11) is wound around the drum (17) for driving the wheel.

2. A wheel board according to claim 1, characterized in that it also comprises castors (13).

3. A wheel board according to claim 1, characterized in that the pivot pin (5) of the first arm (4) is arranged at a first end (6) of the first pivoting arm (4), and the axle (3) of the wheel (2) towards the other end (6').

4. A wheel board according to claim 1, characterized in that the band (11) is connected to the board (1) by means of a second vertically pivoting arm (8) arranged on the board (1).

5. A wheel board according to claim 1, characterized in that the first arm is equipped with an additional return device so that, when the board (1) is not loaded, the drum return device (19) is assisted in returning the central wheel (2) to the lower position relative to said board (1) and facilitates the winding of the band (11) around the drum (17,20) of the wheel.

6. A wheel board according to claim 1, characterized in that the return device is a mechanism for winding the band (11) such as a spiral spring (19).

7. A wheel according to claim 4, characterized in that the first arm (4) is connected to the second arm (8) by a bracket such as a link (7).

8. A wheel board according to claim 1, characterized in that the width of the wheel board (1) is between 0.22 m and 0.35 m.

9. A wheel board according to claim 1, characterized in that the diameter of the wheel is between 0.28 m and 0.40 m.

10. A wheel board according to claim 1, characterized in that it comprises two free wheels (21), two first arms (4), two second arms (8), two links (7) and two bands (11).

11. A wheel board according to claim 1, characterized in that it comprises foot-straps (15).

* * * * *